US006964560B2

(12) United States Patent
Yoshimura

(10) Patent No.: US 6,964,560 B2
(45) Date of Patent: Nov. 15, 2005

(54) VACUUM PUMP

(75) Inventor: Masashi Yoshimura, Yamaguchi (JP)

(73) Assignee: Taiko Kikai Industries Co., Ltd., Yamaguchi (JP)

( * ) Notice: Subject to any disclaimer, the term of this patent is extended or adjusted under 35 U.S.C. 154(b) by 0 days.

(21) Appl. No.: 10/490,870

(22) PCT Filed: Dec. 14, 2001

(86) PCT No.: PCT/JP01/10984

§ 371 (c)(1),
(2), (4) Date: Mar. 26, 2004

(87) PCT Pub. No.: WO03/031820

PCT Pub. Date: Apr. 17, 2003

(65) Prior Publication Data

US 2004/0258551 A1 Dec. 23, 2004

(30) Foreign Application Priority Data

Sep. 27, 2001 (JP) ..... 2001-296873

(51) Int. Cl.[7] ..... F01C 1/16; F01C 1/24

(52) U.S. Cl. ..... 418/201.1; 418/201.2; 418/150; 418/180

(58) Field of Search ..... 418/201.1, 201.2, 418/203, 150, 180

(56) References Cited

U.S. PATENT DOCUMENTS 2,349,022 A * 5/1944 Ungar et al. ..... 418/201.1
2,656,972 A * 10/1953 Rathman ..... 418/201.2
3,677,664 A * 7/1972 Wycliffe et al. ..... 418/201.2
5,135,374 A * 8/1992 Yoshimura et al. ..... 418/201.2
5,667,370 A 9/1997 Im

FOREIGN PATENT DOCUMENTS

EP 0959250 A2 11/1999
JP 2-149893 12/1990

OTHER PUBLICATIONS

Translation of International Preliminary Examination Report.

* cited by examiner

*Primary Examiner*—Theresa Trieu
(74) *Attorney, Agent, or Firm*—Finnegan, Henderson, Farabow, Garrett & Dunner, L.L.P.

(57) ABSTRACT

An object of this invention is to prevent drop of life of a bearing by an axial force when using a pump as a compressor. In a vacuum pump 1 compressing and discharging gas in a direction of a rotor axis by rotation of screw rotors 3, 4 engaged together which are supported rotatably in a casing 2, balance pistons 13, 14 are disposed on shafts 6, 7 of said screw rotors at inlet side of said casing. The balance pistons separate a receiving section 17 at area of the screw rotor and a pressurizing section 16 at area of the balance piston, and a thrust force of the screw rotors at a pressurizing condition is canceled by acting the discharge pressure in the pressurizing section. The pump is used as a compressor when the discharge pressure is acted on the balance pistons 13, 14. When the pump is used as a vacuum pump, air at discharge side is sucked as cool air through a cooler toward a place near to the discharge side of the receiving section 17 at area of the screw rotor.

5 Claims, 4 Drawing Sheets

VACUUM PUMP

BACKGROUND OF THE INVENTION

1. Field of the Invention

This invention relates to a vacuum pump having a function of increasing pressure for vacuum suction and pressure transport by rotating a pair of screw rotors.

2. Description of the Related Art

In technology of air-transporting powder and solid contents (such as cutting, wet refuse, dust, ash, coal, sludge, sand, cement and wheat flour) by a vacuum pump, gas pressure trends to be increased to 2–3.5 $Kg/cm^2G$ in accordance with reduction of pipe diameters and higher-density transport for long-distance transport or volume transport to reduce an initial cost thereof.

Such range of the gas pressure is out of the range of normal blower pressure (lower than the above pressure range) and the pressure range of a compressor (higher than the above pressure range, 7–8 $Kg/cm^2G$ so that when a blower is used for air transport, the blower may be a multi-stage type and when a compressor is used for air transport, the gas pressure may be reduced so as to correspond to the range of gas pressure.

For air transport, a method by vacuum suction and pressure transport is generally used. In the case, both of a vacuum pump and a compressor are required. For example, powder is sucked into a separator tank by the vacuum pump and transported with compressed air by a blower (pressure increase less than 1 $Kg/cm^2G$) or by a compressor (pressure increase more than 1 $Kg/cm^2G$) while the powder in the tank is dropped at constant rate of volume in a pipe by a rotary valve.

When a usual screw-type vacuum pump is used as a compressor, a screw rotor is loaded with a thrust force (axial force) $Fa/4*(Da^2-Db^2)*Pd$ by receiving discharge pressure Pd. The thrust force is added on a bearing at a fixed side of the screw rotor so that life of the bearing may be reduced extremely.

Herein, Da is an outer diameter of a screw, Db is a root diameter of the screw and Pd is discharge pressure. For example, a vacuum pump which has a life Lh=30,000 hours only for a vacuum pump may have a extremely shorten life Lh=few thousands hours when the vacuum pump is used for a compressor with discharge pressure of 3 $Kg/cm^2G$.

Therefore, increasing a shaft diameter of the rotor for a larger bearing, the root diameter of the screw is increased so that discharge air volume at one rotation of the screw rotor is reduced. Increasing rotating speed of the screw rotor for compensating the reduction, vibration and noise will be increased and lubricity might be increased. Alternatively, enlarging the outer diameter of the screw rotor for increasing the discharge volume, size of the pump might be increased.

In order to overcome the above drawback, the object of this invention is to provide a vacuum pump having a function of increasing pressure which can have a longer life of the bearing when the pump is used as a compressor for pressure of 2–3.5 $Kg/cm^2G$ and also can be used as a vacuum pump by closing an inlet thereof.

SUMMARY OF THE INVENTION

In order to attain the above object, a vacuum pump according to claim 1 of this invention comprises: compressing and discharging gas in a direction of a rotor axis by rotation of a pair of screw rotors with a cross section perpendicular to the axis formed with an epitrochoid, an arc and an Archimedean-spiral-like curve, wherein the pair of screw rotors engaged together are supported rotatably in a casing, wherein balance pistons are disposed respectively on shafts of the pair of screw rotors at an inlet side of the casing so as to separate a receiving section of the screw rotor and a pressurizing section of the balance piston, wherein a thrust force of the screw rotor at a pressurizing condition is canceled by acting the discharge pressure in the pressurizing section, wherein each balance piston includes a plurality of plate portions and spaces between respective plate portions, and wherein the plate portions of one balance piston are penetrated rotatably into the space of the other balance piston.

According to the above structure, pressure at inlet side is low and pressure at discharge side is high by rotation of the pair of screw rotors so that the pair of screw rotors are pushed toward the inlet side. Thereby, the thrust force (force in an axial direction) might be acted on the bearing of the shaft of the screw rotors. However, the pressure at the discharge side acts on the balance piston so as to push the balance piston together with the shaft toward the discharge side. Therefore, the thrust force on the bearing is canceled and excessive force may not be loaded on the bearing.

The vacuum pump according to claim 2 of this invention, is specialized in the vacuum pump according to claim 1 by that each balance pistion includes a plurality of plate portions and spaces between respective plate portions, and the plate portions of one balance pistion are penetrated rotatably into the spaces of the other balance piston.

According to the above structure, labyrinth seal is formed by spaces between the plurality of plate portions so that leakage by pressure from the pressure section to the receiving section can be limited in an extremely small value although outer surfaces of the plate portions are not contacted with inner surfaces of the receiving section. The plate portions of the both balance pistons are disposed alternately so that leakage through the spaces between the both balance pistons is prevented.

The vacuum pump according, claims 1 and 2 of this invention comprises a vacuum pump defined by a distance H between axes of the shafts by $H=(D_1+D_2)/2=(Da+Db)/2$; herein $D_1$ is an outer diameter of the balance piston, $D_2$ is a root diameter of the balance piston, Da is an outer diameter of the screw rotor, and $D_b$ is a root diameter of the screw rotor.

According to the above structure, the outer diameter $D_1$ of the balance piston equals to the outer diameter Da of the screw rotor and the root diameter $D_2$ of the balance piston equals the root diameter Db of the screw rotor. Thereby, pressured areas of the balance piston and the screw rotor are the same and the thrust forces caused by discharge pressure at the balance piston and the screw rotor are the same so that the thrust force acting on the bearing is canceled securely.

The vacuum pump according to claims 1–3 of this invention comprises a pump used as a compressor when the discharge pressure is acted on the balance piston. Air at the discharge side is sucked in as cool air, through a cooler near the discharge side of the receiving section of the screw rotor, when the pump is used as a vacuum pump.

According to the above structure, when the pump as a compressor makes the discharge side in high pressure, wear of the bearing is prevented with the balance piston. When air pressure at the inlet side is set in vacuum condition and air pressure at the discharge side is set in atmospheric pressure for the vacuum pump, the discharge side is cooled by the cool air from the cooler. Thereby, powder is sucked securely and the screw rotors are cooled.

The vacuum pump according to claims 3 and 4 of this invention comprises an exhaust port of the casing connected with the cooler, wherein the cooler connected with the pressurizing section through a first inlet valve and with a position near the discharge side through a second inlet valve, and wherein the first and second inlet valves are selectively closed or opened for performing the pump as the compressor or the vacuum pump.

According to the above structure, when the pump is used as the compressor, the first inlet valve is closed and the second inlet valve is opened. When the pump is used as the vacuum pump, the first inlet valve is opened and the second inlet valve is closed. Part of high pressure gas discharged from the exhaust port led into the cooler is cooled and transported through the inlet valve to the pressurizing section or the discharge side of the receiving section at side of the balance piston. Thereby, the pressurizing section or the discharge side of the receiving section is cooled by the cool gas.

The vacuum pump according to claims 1–5 of this invention comprises an orifice disposed at an inlet port of the pressurizing section. The discharge pressure is acted through the orifice to the pressurizing section.

According to the above structure, pressure in the pressurizing section is prevented from increasing over requirement. Thereby, increasing leakage from the balance piston to the receiving section and drop of volumetric efficiency of the vacuum pump are prevented.

DESCRIPTION OF THE PREFERRED EMBODIMENT

An embodiment according to this invention will be described with reference to drawings.

Figure 1:
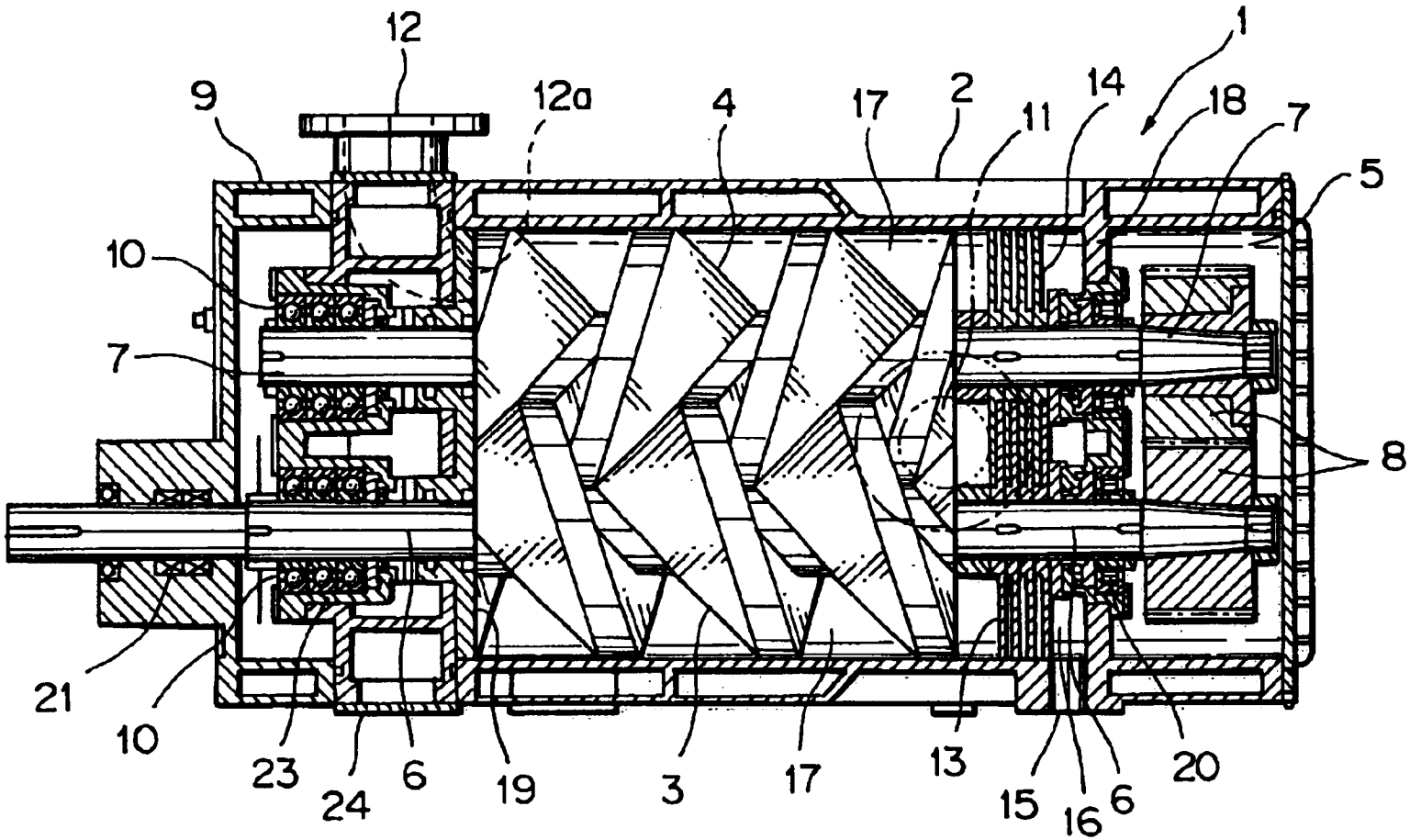
FIG. 1 is a sectional view of one embodiment of a vacuum pump according to this invention.

FIG. 1 is a sectional view showing a inner structure of the embodiment of the vacuum pump according to this invention.

The vacuum pump 1 includes a set of right hand spiral and left hand spiral screw rotors 3, 4 engaged with each together disposed in a metal-made casing 2. One ends of respective shafts 6, 7 of the set of screw rotors 3, 4 are interlocked rotatably through respective timing gears 8 in a gear case section 5 at one end of the casing 2. The other ends of respective shafts 6, 7 of the set of screw rotors 3, 4 are supported rotatably by respective bearings 10 in a bearing cover 9 at the other end of the casing 2. An inlet port 11 is provided at the one end of the casing 2 and an exhaust port 12 is provided at the other end of the casing 2. A pair of balance pistons 13, 14 are disposed at a near side to the inlet port 11 in the casing 2. One balance piston 13 is fixed on the shaft 6 of one screw rotor 3 and the other balance piston 14 is fixed on the shaft 7 of the other screw rotor 4 so as to rotate respective balance pistons 13, 14 freely together with respective screw rotors 3, 4. A pressurizing section 16 is formed at the one end separated with the balance pistons 13, 14 and a receiving section 17 is placed at the other end (side of the screw rotors) continuous to the inlet port 11. Pushing forces along axes of the set of screw rotors 3, 4 caused by discharge pressure are cancelled by pressure from a pressurizing inlet 15 acting on the balance pistons 13, 14 so that overloaded axial load on the bearings 10 is prevented.

Figure 4:
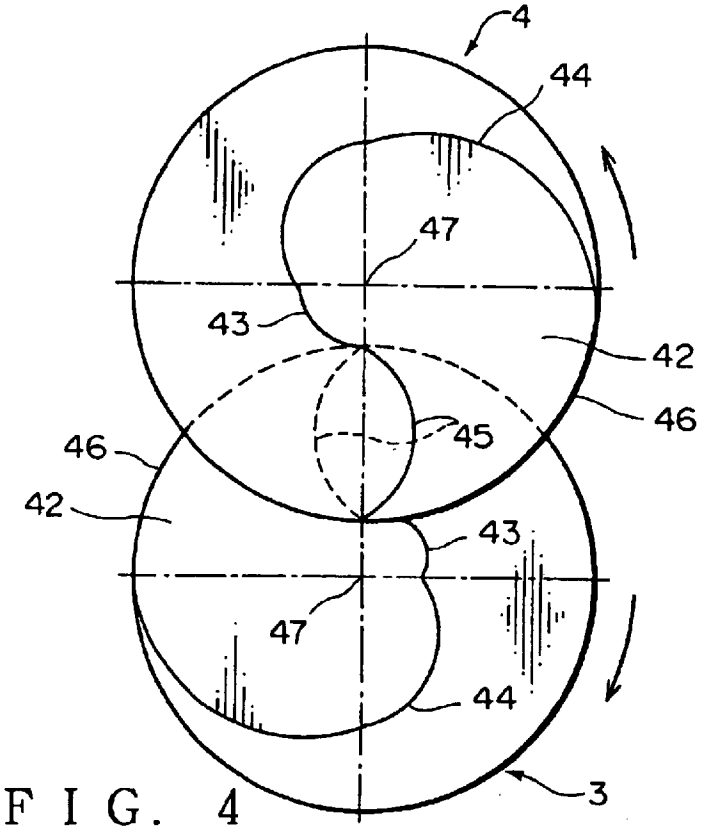
FIG. 4 is a drawing (for explanation) of a sectional shape perpendicular to a axis, showing one embodiment of a screw rotor of the vacuum pump.

The casing 2 is formed into spectacles shape in a widthwise direction (perpendicular to the axis) so as to receive the set of screw rotors 3, 4 in parallel, and has the inlet port 11 at the one side along an axial direction and the exhaust port 12 at the other side. The screw rotors 3, 4 later-described in detail in FIG. 4 are generally used. The casing 2, the bearing cover 9 and the gear case section 5 are separated airtight by partition walls 18, 19 therebetween. In this embodiment, the casing 2 and the gear case (called with the mark 5) are integrated. Respective shafts 6, 7 of the set of screw rotors 3, 4 penetrate through respective partition walls 18, 19 and project into the gear case section 5 and the bearing cover 9.

At near side of one partition wall 18, respective shafts 6, 7 are supported rotatably by roller bearings 20 as one bearing and fixed with the timing gears 8 in the gear case section 5 each by a key and a taper member. The roller bearings 20 are provided respectively with an inner ring, an outer ring and a plurality of cylindrical rollers between the inner and outer rings, and support the shafts 6, 7 so as to be slightly movable in an axial direction. Thereby, the extension in the axial direction of the shafts 6, 7 by thermal expansion in use can be absorbed. The pair of timing gears 8 is engaged with each other. The narrow pressurizing section 16 (empty space) is formed between the partition wall 18 and the balance pistons 13, 14, and communicated through the pressurizing inlet 15 (inlet) with an outer area.

Figure 3:
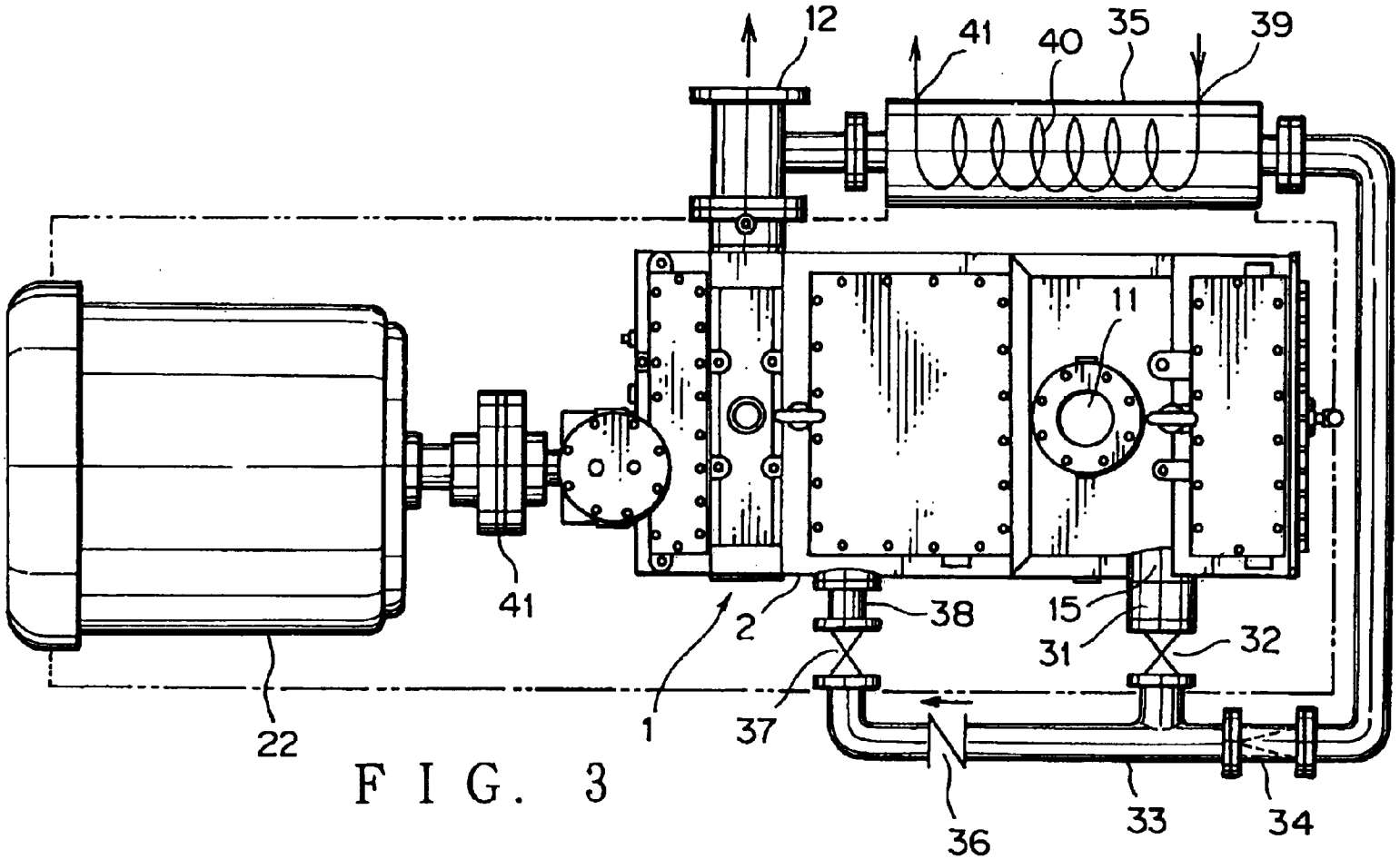
FIG. 3 is a plan view, showing an outline of the vacuum pump, a drive mechanism and a piping structure.

In the bearing cover 9 outside of the other partition wall 19 of the casing 2, respective shafts 6, 7 are supported by angular ball bearings 10 as the other bearings. An extending portion of one shaft 6 extending outward is sealed by a double mechanical seal 21 and connected with a motor 22 (FIG. 3). The angular ball bearings 10 are triple combined angular ball bearings which three bearings make one set and two of the three bearings receive thrust force. The each bearing includes an inner ring, an outer ring and a plurality of balls between the rings. Respective inner rings are fitted and fixed on an outer surfaces of the shafts 6, 7, and respective outer rings are fixed in a holder 23 for common use which is fixed in a frame wall 24 continuous to the partition wall 19. In the triple combined angular ball bearings 10, ball contact angles of two bearings at front side are different from ball contact angles of one bearing at rear side.

Rolling resistance of the angular ball bearing 10 is lower than that of the roller bearing 20 so that angular ball bearing 10 is suitable for high speed rotation. The roller bearing 20 allows the shafts 6, 7 to move in axial direction, differently from the angular ball bearing 10, and receives heavy load in radial direction but does not receive thrust force. The triple combined angular ball bearings 10 can endure thrust force. For longer bearing life, the balance pistons 13, 14 are provided to cancel the thrust force generated by discharge pressure acting on the screw rotors 3, 4.

Figure 2:
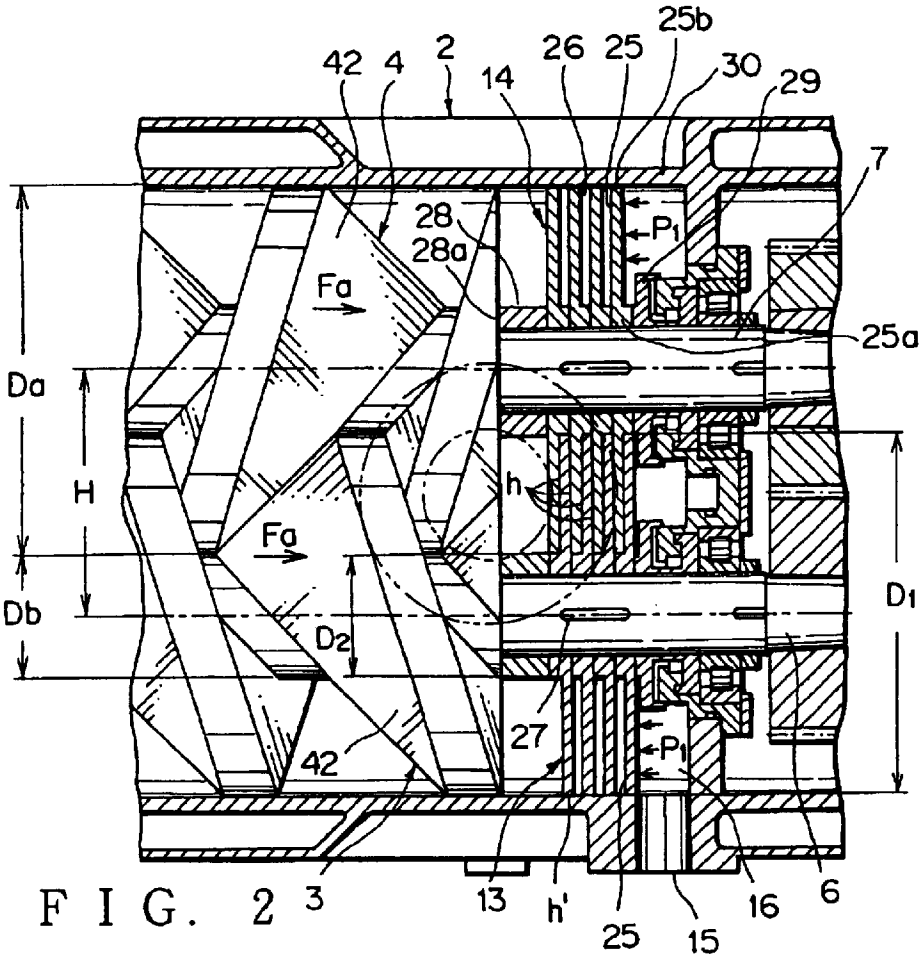
FIG. 2 is an expanded sectional view, showing assembling area of a balance piston of the vacuum pump.

The balance pistons 13, 14 are formed with a set of right-and-left pistons to be disposed symmetrically about front and rear, as shown in FIG. 2. The right-and-left balance pistons 13, 14 are structured by stacking a plurality of metal disc-shape plates 25 (four plates in this embodiment) in the axial direction. The plate 25 includes a small diameter boss portion 25*a* projecting from the center of the plate and a large diameter plate main body 25*b* (plate portion), coaxial with the boss portion 25*a*, having thickness slightly thinner than that of the boss portion 25*a*.

Respective boss portions 25*a* are connected together in the axial direction so as to dispose respective plate main bodies 25*b* in parallel and provide ring-shape spaces 26 between respective plate main bodies 25*b*. The plate main bodies 25*b* of the adjacent balance piston (13 or 14) are disposed rotatably in the spaces 26. Respective plate main bodies 25*b* are positioned mutually with a small gap in a non-contact condition. By using a material with small thermal expansion coefficient, gaps between both balance pistons 13, 14 can be smaller so as to decrease leakage through the gap.

Outer diameters of respective plate main bodies 25*b*, i.e. outer diameters of the balance pistons 13, 14, are the same as outer diameters of the screw rotors 3, 4. Outer diameters of respective boss portions 25*a*, i.e. root diameters of the balance pistons 13, 14, are the same as root diameters of the screw rotors 3, 4. Defining Da as the outer diameter of the screw rotor 3, 4, Db as the root diameter of screw rotor 3, 4, $D_1$ as the outer diameter of the balance piston 13, 14, $D_2$ as the root diameter of the balance piston 13, 14, H as a distance between axes of the shafts 6, 7, H is shown by $H=(D_1+D_2)/2=(Da+Db)/2$.

The balance pistons 13, 14 are positioned and fixed immovably in a round direction at inner diameter sides of respective boss portions 25*a* on the shafts 6, 7 with keys 27. Front ends of the balance pistons 13, 14 abut on an end surface 28*a* of the root portion 28 of the screw rotors 3, 4, and rear ends of the balance pistons 13, 14 abut on stopper plates 29. The balance pistons 13, 14 can move a short distance (near to a clearance of bearing) in the axial direction together with the screw rotors 3, 4 and the shafts 6, 7. The screw rotors 3, 4 are fixed immovably in the round direction and the axial direction with keys on the shafts 6, 7.

The plurality of plate main bodies 25*b* of the balance pistons 13, 14 and the spaces 26 therebetween structure a labyrinth seal. Thereby, leakage by pressure through a gap h' between the outer surface of the plate main body 25*b* and an inner surface of an inner cylindrical portion 30 of the casing 2 is reduced by adding gas pressure (air pressure) from the pressurizing inlet 15. Seizing by contact of the balance pistons 13, 14 and the casing 2 is prevented by the narrow gap h'.

The balance pistons 13, 14 may be manufactured by forming a plurality of ring-shape spaces 26 in parallel on one short cylindrical metal member instead of the plurality of plates 25 if workable. The spaces 26 between the plate main bodies 25 are not for working as a pump, but they are for ensuring sealing between a front room and a rear room separated by the balance pistons 13, 14 (the receiving section 17 and the pressurizing section 16).

Respective plate main bodies 25*b* of the balance pistons 13, 14 are engaged rotatably with each other to have a small axial gap h by disposing alternately. A pair of balance pistons 13, 14 is received rotatably together with respective screw rotors 3, 4 in the receiving section 17 with a shape formed by connecting spectacles-shaped rooms of the casing 2 in a radial direction (figure of 8) as a pair of screw rotors 3, 4. The pressurizing section 16 between one partition wall 18 and respective balance pistons 13, 14 in the casing 2 communicates to the pressurizing inlet 15.

As showing connecting structure of the vacuum pump, outer pipes and the motor 22 in FIG. 3, the pressurizing inlet 15 is continuous through an orifice 31 as a choke portion and a first inlet valve 32 to the outer pipe 33. Along left-handed rotation in FIG. 3, the pipe 33 is continuous through a filter 34 to a transporting air cooler 35, and the transporting air cooler 35 is continuous through a short pipe to the exhaust port 12 at front end of the casing 2. Along right-handed rotation, the pipe 33 is continuous through the first inlet valve 32, a check valve 36 and a second inlet valve 37 to a cooling air inlet port 38 (entrance). The cooling air inlet port 38 is located at an opposite side of 180 degrees turn to the exhaust port 12 in radial direction and nearer to the inlet port 11 than the exhaust port 12 in axial direction.

The exhaust port 12 communicates to a room 17 at area of the exhaust port of the screw rotors 3, 4, as shown in FIG. 1. The transporting air cooler 35 includes a cooling water inlet 39, a spiral cooling water path 40, a cooling water outlet 41 and a discharge air path therein, and cools gas discharged from the exhaust port 12 and transports the gas toward the pressure inlet 32. The filter 34 removes dust from the gas cooled at the transporting air cooler 35. The first inlet valve 32 can be opened and closed freely. By an operation of opening the first inlet valve 32, gas with discharge pressure is transported through the orifice 31 to the pressurizing section 16 (FIG. 1) at area of the balance pistons 13, 14 (during this operation, the second inlet valve 37 is closed). The orifice 31 prevents excessive pressure increase in the pressurizing section 16 and the receiving section 17 when transporting the pressurized gas (used as a compressor).

The second inlet valve 37 can be also opened and closed freely. The cooled gas from the transporting air cooler 35 is transported from the cooling air inlet port 38 into the receiving section 17 at area of the exhaust port of the screw rotors 3, 4 of the casing 2 in a condition of closing the first inlet valve 32. The check valve 36 prevents back flow of gas from the cooling air inlet port 38 at low vacuum condition.

In FIG. 3, mark 11 is the inlet port 11 of the casing 2 and mark 22 is the motor. The inlet port 11 maybe connected by piping with a separator tank receiving air and powder to be gathered by vacuum. The motor 22 is joined through a shaft coupling 41 with the shaft 6 of driving side shown in FIG. 1.

Actions of the vacuum pump 1 having a function of increasing pressure according to this invention will be described in detail as following.

When the vacuum pump 1 is used as a compressor, the first inlet valve 32 in FIG. 3 is opened and the second inlet valve 37 is closed. The screw rotor 3 of driving side in FIG. 1 is rotated by driving the motor 22, and simultaneously the screw rotor 4 of driven side is rotated in a direction opposite to that of the driving side 3 through the timing gear 8. Thereby, gas is compressed in accordance with nearing to the exhaust side 12 and gas pressure is increased (may be 2–3.5 $Kg/cm^2G$, for example).

When pressure at the exhaust side is increased, respective screw rotors 3, 4 are loaded with axial forces toward the inlet side along arrows Fa shown in FIG. 2. Thereby, the inner rings of the bearings 10 (angular ball bearings) abutting at the exhaust side on the shafts 6, 7 of respective screw rotors 3, 4 may be pushed along the arrows Fa to load the axial forces (forces damaging the bearings) on the bearings 10.

Herein, compressed gas is transported along an arrow from the exhaust port 12 to a not-shown pipe, and simultaneously part of the compressed gas is transported through the transporting air cooler 35 and the filter 34, and through the first inlet valve 32 and the orifice 31 into the pressurizing section 16 at the inlet side of the balance pistons 13, 14. Thereby, the balance pistons 13, 14 are load uniformly at one end surfaces thereof with pressure along an arrow $P_1$ shown in FIG. 2, and push the screw rotors 3, 4 in a direction opposite to the axial force Fa so that the axial forces Fa loading on the bearings 10 is canceled.

The same discharge pressure acts simultaneously in the opposite directions on the screw rotors 3, 4 and the balance pistons 13, 14 so that the axial forces on the screw rotors 3, 4 are canceled and the lives of the bearings 10 are extremely extended.

Since the roller bearings 20 can absorb axial forces as mentioned above, the roller bearings 20 are not completely loaded with the axial forces Fa and the angular ball bearings 10 are loaded with all axial forces Fa.

When air is transported by pressure, it is required that the air to be led to the first inlet valve 32 is cooled by the transporting air cooler 35. Thereby, the balance pistons 13, 14 are cooled (inlet side is cooled). When the pump is used as a vacuum pump, the first inlet valve 32 is closed.

Defining Da as the outer diameter of the screw rotor 3, 4, Db as the root diameter of the screw rotor, Pd as the discharge pressure and Fa as the axial force, the axial force Fa $(Da^2-Db^2)Pd*\delta/4$. The screw rotors 3, 4 are acted with alternating load (repeated load with the same positive-negative amplitude) as radial loads in a radial direction. The load is far smaller than the aforesaid axial forces so that the load is not a problem to be solved.

The orifice 31 is disposed between the first inlet valve 32 and the pressurizing inlet 15. It is for preventing pressure rising over than requirement to provide a pressure choke with consideration of the life of the bearing 10 and drop in efficiency by leakage through a gap because leakage through a gap from the balance pistons 13, 14 is increased by pressure in the pressurizing section 16.

Generally, leak rate through a gap is given by following formula:

$$G=0.000313\cdot V\cdot F\cdot\{P_1/(Z+1.5)U_1{}^*60\}$$

Herein, G: Leak rate through a gap, $P_1$: Pressure at high pressure side $Kg/cm^2ab$, U: Specific volume $RT/P_1$ $m^3$, R: Gas constant=29.27 Kgfm/KgfK, $P_0$: Pressure at low pressure side 1.033 $Kg/cm^2ab$, Z: Choke step number of labyrinth seal, f: Average gap area of the choke, V: Flow coefficient, Pc: Critical pressure $Kg/cm^2$, $Pc=0.85P_1/(Z+1.5)$. Root is applied to whole in braces {and}.

Thus, the orifice 31 adjusts the pressure $P_1$ at high-pressure side (side of the pressurizing section) and controls leak rate trough the gap to prevent reduction of volumetric efficiency. Although the inlet valve 32 can perform the same function instead of the orifice 31, the inlet valve 32 can be operated only to be full open or totally closed by choking previously with the orifice 31 so that the operation (control) may be simple.

It is assumed that the life of the bearing 10 is Lh=30,000 hours or more against the discharge pressure of 2 $Kg/cm^2G$ or less. When the discharge pressure Pd is more than 2 $Kg/cm^2G$, for example Pd=3.5 $Kg/cm^2G$, the life Lh=30,000 Hours can be reached to set $P_1=3.5-2=1.5$ ($Kg/cm^2$). To set pressure of the pressurizing section 16 $P_1=3.5$ $Kg/cm^2G$, the life is given by Lh=(almost no chance to be broken). Conversely, the leak rate through a gap G from the balance pistons 13, 14 is increased and the volume efficiency of the vacuum pump 1 (compressor) is reduced.

For increasing the volume efficiency, gaps between the outer surfaces of the balance pistons 13, 14 and the inner surface of the casing 2 and gaps between respective balance pistons 13, 14 must be narrowed so as to decrease the leakage through gaps. To decrease the gaps, ductile cast iron, for example Nobinite cast iron, which thermal expansion coefficient is about ⅕ compared with that of normal iron can be used effectively as a material for the balance piston and the casing. The material can be also applied for screw rotor.

When the vacuum pump 1 is used for exhausting by vacuum, the first inlet valve 32 is closed and the second inlet valve 37 is opened in FIG. 3. The inlet port 11 of the casing 2 is connected with a tank receiving gas of the exhausted side and solvent (liquid). The inlet port 11 can be completely closed by an inlet valve (not shown). The first and second inlet valves 32, 37 can be switched electrically.

The pair of screw rotors 3, 4 are rotated by the motor 22 as the case when the pump is operated as the compressor, and powder may be sucked into a separator tank.

After part of gas discharged to the exhaust port 12 in FIG. 3 is led to the transporting air cooler 35 and cooled, the part of gas is filtered by the filter 34 disposed at an intermediate position of the pipe 33, and led through the check valve 36 from the second inlet valve 37 through the cooling air inlet port 38 into the receiving section 17 near to the discharge side (180 degree opposite side against the exhaust port 12). Thereby, the receiving section 17 and the screw rotors 3, 4 are cooled, and compression of the solvent in the receiving section 17 is accelerated so that suction force by the screw rotors 3, 4 is increased and the pump is acted exceedingly as the vacuum pump.

The screw rotors 3, 4 are provided with a right-handed spiral drive side 3 connected directly with the motor 22 (FIG. 3) and a left-handed spiral driven side 4 rotated through the timing gear 8 as shown in FIG. 1. Respective screw rotors 3, 4 formed symmetrically by reversing the same shape in 180 degree turn are engaged slidably with each other. Respective screw rotors 3, 4 includes a root portion 28 (FIG. 2), an asymmetric spiral tooth 42 outside the root portion 28, and the shafts 6, 7 inside the root portion 28.

FIG. 4 shows a sectional view, in a direction perpendicular to the axis, of engaged pair of screw rotors 3, 4. Each spiral tooth 42 has an arc portion 43 being a quarter circle of a small diameter of an outer surface of the root portion 28 (FIG. 2), an Archimedean-spiral-like curve 44 continuous to one end of the arc portion 43, an epitrochoid curve 45 continuous to the other end of the arc portion 43 and a large arc portion 46 of the outer surface of the spiral tooth. Tail ends of the Archimedean-spiral-like curve 44 and the epitrochoid curve 45 are smoothly continuous to the large arc portion 46. Mark 47 in FIG. 4 shows a center of rotation.

The pair of screw rotors 3, 4 rotate in opposite directions to each other as shown by arrows in the casing 2. Gas is moved in the same volume without compression to a predetermined position. The gas is compressed while the screw rotors rotate from a position where the exhaust port 12*a* (FIG. 1) disposed at the partition wall 19 of the side case 9 is closed by an end surface of the screw rotor 4 to a position just before the exhaust port 12*a* is opened by a half turns and exhausted just when the exhaust port 12*a* is opened. Detail explanation is shown in Japan Patent Application No. S63-36085.

The balance pistons 13, 14 (FIG. 1) according to this invention can be applied for a vacuum pump using screw rotors other than the screw rotor having aforesaid curves. Not only a plurality of balance pistons 13, 14 but also one balance piston 13, 14 maybe allowable if the sealing performance is good enough. The plurality of balance pistons may be integrated to one part. Number of the plate main bodies 25*b* (FIG. 2) may be two, three or more. As labyrinth sealing, four plate main bodies may be suitable.

In the aforesaid embodiment, the screw rotors 3, 4, the shafts 6, 7 and the balance pistons 13, 14 rotate as one integrated part in the same rotating speed. The balance pistons 13, 14 can be supported rotatably by thrust bearings to be separated from the shafts 6, 7. In this case, it is required that the balance pistons 13, 14 abut on the end surfaces 28*a* of the screw rotors 3, 4 with no gap and no looseness in an axial direction.

Figure 5:
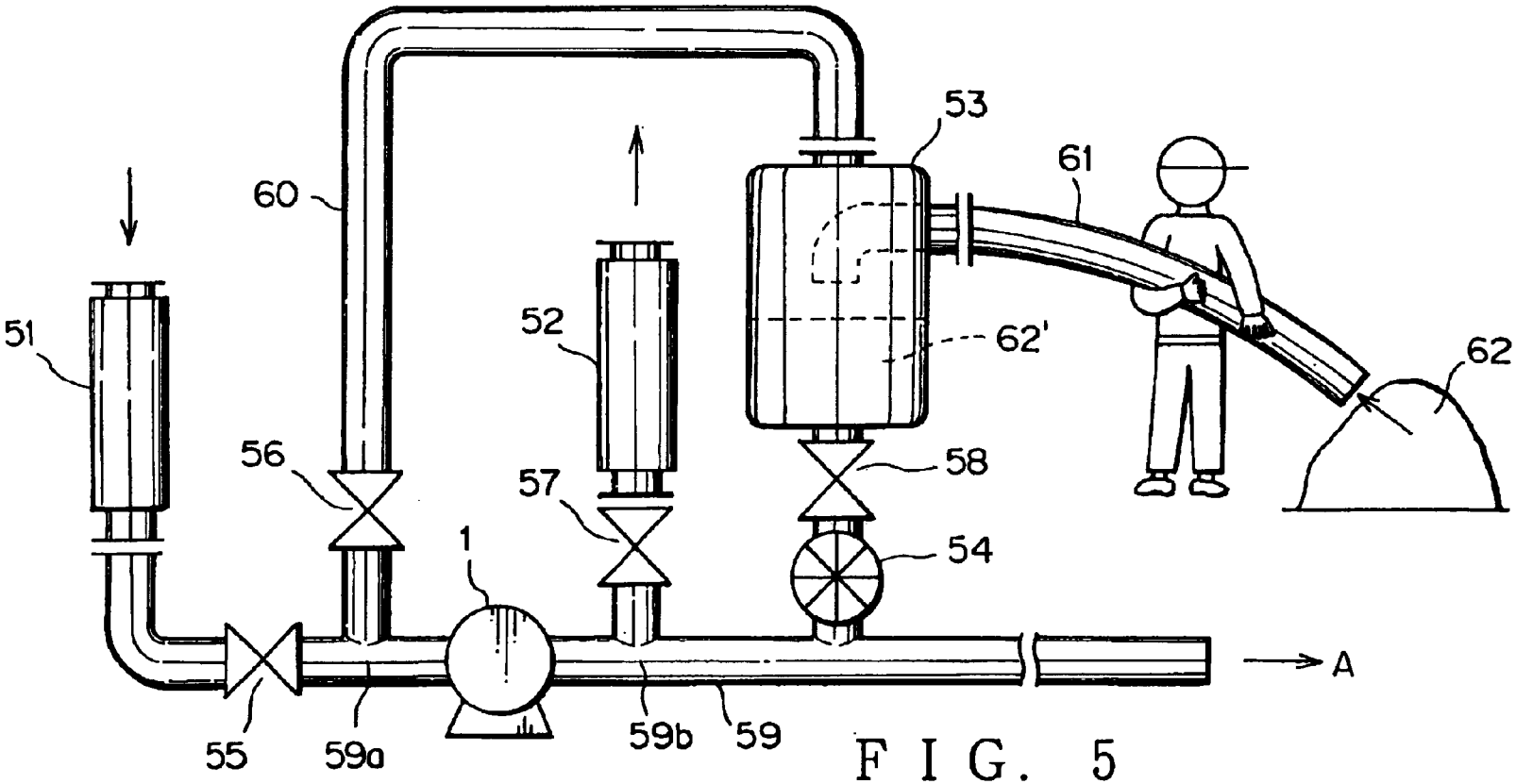
FIG. 5 is a drawing for explanation, showing one embodiment of a condition in use of the vacuum pump.

FIG. 5 shows one embodiment of a condition in use of the aforesaid vacuum pump. In FIG. 5, mark 1 is the vacuum pump, marks 51, 52 are silencers, mark 53 is the separator tank, mark 54 is a rotary valve, marks 55–58 are valves, marks 59, 60 are pipes, mark 61 is a suction hose and mark 62 is a sucked object such as powder.

A first valve 55 is disposed at a suction side pipe 59*a* connecting a silencer 51 and the inlet port of the vacuum pump 1. A second valve 56 is disposed at a pipe 60 connecting the tank 53 and the suction side pipe 59*a*. A third valve 57 is disposed at a middle portion of a pipe connecting a discharge side pipe 59*b* of the vacuum pump 1 and the silencer 52. A fourth valve 58 is disposed between the tank 53 and the rotary valve 54.

For sucking, opening the second valve 56 and the third valve 57 and closing the first valve 55 at an opposite side to a direction of pressure transporting (direction along an arrow A) and the fourth valve 58 under the tank, a worker operates the vacuum pump 1 to suck the sucked object 62 with the suction hose 61 into the tank 53.

For pressure-transporting (air transport) a sucked object 62', conversely closing the second and third valves 56, 57 and opening the first and fourth valves 55, 58, the sucked object 62' in the tank 53 is dropped with a constant volume into a base pipe 59 by the rotary valve 54 and pressure-transported with the discharge pressure of the vacuum pump 1 by operating the vacuum pump 1.

EFFECTS OF THE INVENTION

According to claim 1 of this invention, when the pump is used as a compressor, the balance pistons cancel the large thrust force loaded on the bearing of the screw rotors. Thereby, the load on the bearing is reduced and the life of the bearing is extremely extended. Thus, the vacuum pump can be used as a compressor having discharge pressure of 2–3.5 $Kg/cm^2G$, without problems. Piping for air-transporting powder or solid matters can also be reduced in size. High density transport for long-distance transport and mass transport can be performed only by the vacuum pump without a compressor. In addition, pressure leakage from the pressurizing section, on he side of the balance pistions, to the receiving section, on the side of the screw rotor, is controlled in extremely small amounts so that reduction of compression efficiency on the side of the screw rotors is prevented.

According to claim 2 of this invention, leakage by pressure from the pressurizing section at the balance pistions side to the receiving section at screw rotors side is controlled in extremely small amount so that reduction of compression efficiency at screw rotor side is prevented.

According to claim 2 of this invention, areas of the balance piston and the screw rotor are loaded with the same pressure so that the thrust forces on the balance piston and the screw rotor are the same in magnitude (opposite directions of the forces). Thereby, the thrust force loading on the bearing is canceled, and the life of the bearing is improved more securely.

According to claim 3 of this invention and as mentioned above, wear of the bearing is prevented by the balance pistons when the pump is used as a compressor. When the pump is used as a vacuum pump, the exhaust port side is cooled by cool air from the cooler so that vacuum suction of powder can be performed securely. Additionally, the screw rotors are cooled so that contacting/seizing of the screw rotors and the casing by thermal expansion of the screw rotors is prevented.

According to claim 4 of this invention, performing the pump as a compressor or a vacuum pump can easily be switched by opening or closing the respective inlet valves. Contacting/seizing of the balance pistons and the casing by thermal expansion of the balance pistons is prevented by cooling the balance pistons.

According to claim 5 of this invention, pressure in the pressurizing section is prevented from increasing over the requirement. Thereby, increase in leakage from the balance piston into the receiving section and drop in volumetric efficiency of the vacuum pump is prevented. In addition, thrust force is canceled by the balance pistons and drop of compression efficiency by the screw rotors is prevented.

What is claimed is:

1. A vacuum pump, compressing and discharging gas in a direction of a rotor axis by rotation of a pair of screw rotors with a cross section perpendicular to the axis formed with an epitrochoid, an arc and an Archimedean-spiral-like curve, said pair of screw rotors engaged together being supported rotatably in a casing, comprising balance pistons being disposed respectively on shafts of said pair of screw rotors at inlet side of said casing, wherein said balance pistons separate a receiving section at area of the screw rotor and a pressurizing section at area of the balance piston, and a thrust force of the screw rotors at a pressurizing condition is canceled by acting the discharge pressure in the pressurizing section, wherein said each balance piston includes a plurality of plate portions and spaces between respective plate portions, and said plate portions of one balance piston are penetrated rotatably into said spaces of the other balance piston.

2. The vacuum pump according to claim 1, wherein a distance H between axes of said shafts is defined by $H=(D_1+D_2)/2=(Da+Db)/2$, herein $D_1$ as an outer diameter of said balance piston, $D_2$ as a root diameter of said balance piston, Da as an outer diameter of said screw rotor, Db as a root diameter of said screw rotor.

3. The vacuum pump according to claim 1 or 2, wherein the pump is used as a compressor when said discharge pressure is acted on the balance piston, and air at discharge side is sucked as cool air through a cooler toward a place near to the discharge side of the receiving section at area of the screw rotor when the pump is used as a vacuum pump.

4. The vacuum pump according to claim 3, wherein an exhaust port of said casing is connected with said cooler, and said cooler is connected through a first inlet valve with said pressurizing section and through a second inlet valve with a position near to the discharge side, and the both inlet valves are closed or opened selectively for performing the pump as the compressor or the vacuum pump.

5. The vacuum pump according to any one of claims 1, 2, or 4, wherein an orifice is disposed at an inlet port of said pressurizing section, and said discharge pressure is acted through said orifice to said pressurizing section.

* * * * *